US007416446B2

(12) United States Patent
Koyama et al.

(10) Patent No.: US 7,416,446 B2
(45) Date of Patent: Aug. 26, 2008

(54) CONNECTOR

(75) Inventors: Ryozo Koyama, Tokyo (JP); Eiji Wakatsuki, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 51 days.

(21) Appl. No.: 11/594,902

(22) Filed: Nov. 9, 2006

(65) Prior Publication Data

US 2007/0141901 A1 Jun. 21, 2007

(30) Foreign Application Priority Data

Dec. 20, 2005 (JP) ..... 2005-366908

(51) Int. Cl.
*H01R 13/648* (2006.01)

(52) U.S. Cl. ..... 439/607

(58) Field of Classification Search ..... 439/607–610
See application file for complete search history.

(56) References Cited

U.S. PATENT DOCUMENTS

2005/0277332 A1* 12/2005 Chen ..... 439/607
2007/0105440 A1* 5/2007 Delaney et al. ..... 439/607
2007/0167076 A1* 7/2007 Seh et al. ..... 439/607

FOREIGN PATENT DOCUMENTS

JP 07-220814 8/1995

OTHER PUBLICATIONS

European Search Report, Apr. 4, 2007.

* cited by examiner

*Primary Examiner*—Gary F. Paumem
(74) *Attorney, Agent, or Firm*—Kubotera & Associates, LLC

(57) ABSTRACT

A connector includes a housing, a housing cover for covering at least part of the housing, and a plurality of terminals arranged in the housing. The housing cover has a tongue portion extending in a direction perpendicular to the plugging direction. The side edge of the tongue portion is brought into close contact with the housing by means of cutting by the tongue portion.

15 Claims, 5 Drawing Sheets

CONNECTOR

BACKGROUND OF THE INVENTION

1. Field of the Invention

The invention relates to a connector with a housing cover and, particularly, to a connector with part of a housing cover embedded therein.

2. Description of the Related Art

FIGS. 7 and 8 are top and rear views of a conventional connector 100 with a housing cover that is disclosed in Japanese Publication No. 7-220814. The connector 100 includes a housing 121, a metal cover 110 to cover part of the housing 121, and a contact 130 fixed to the housing 121. As best shown in FIG. 8, a strip portion 115 of the metal cover 110 is bent into the indentation 124 of the housing 121 to fix the metal cover 110 to the housing 121.

The width (K) of the strip portion 115 is set less than the width (L) of the indentation 124 in the plugging direction so that there is a gap (M) between the strip portion 115 and the indentation 114. Consequently, there is a play between the metal cover 110 and the housing 121 or a crack in the solder between the metal cover 110 and a board. The height of the metal cover 110 becomes large because there is a space where the strip portion 115 is bent vertically.

SUMMARY OF THE INVENTION

Accordingly, it is an object of the invention to provide a compact connector having a high fixing power between the metal cover and the housing.

According to the invention there is provided a connector which comprises a housing; a housing cover for covering at least part of said housing; a plurality of terminals arranged in said housing; and a tongue portion extending from said housing cover in a direction perpendicular to a plugging direction such that a side of said tongue portion is brought into close contact with said housing.

The housing may have a dent made by said tongue portion. The tongue portion may be provided at a rear end of said housing cover in said plugging direction. The connector may further comprises a protruded portion extending rearward from said housing, around which said tongue portion is folded. The protruded portion may be provided on each of opposite sides of said housing and said tongue portion may be provided on each of opposite sides of said housing cover.

The housing may be provided with a tapered portion in which said tongue portion is embedded. The tongue portion may be provided with a side edge that cuts part of said housing. The tongue portion may be attached to said housing near a position where said mating connector is locked to said connector. The said tongue portion may be made of metal such that it has a width in said plugging direction.

According to the invention there is provided a connector with a housing to which a housing cover is secured more firmly.

DESCRIPTION OF THE PREFERRED EMBODIMENTS

Figure 1:
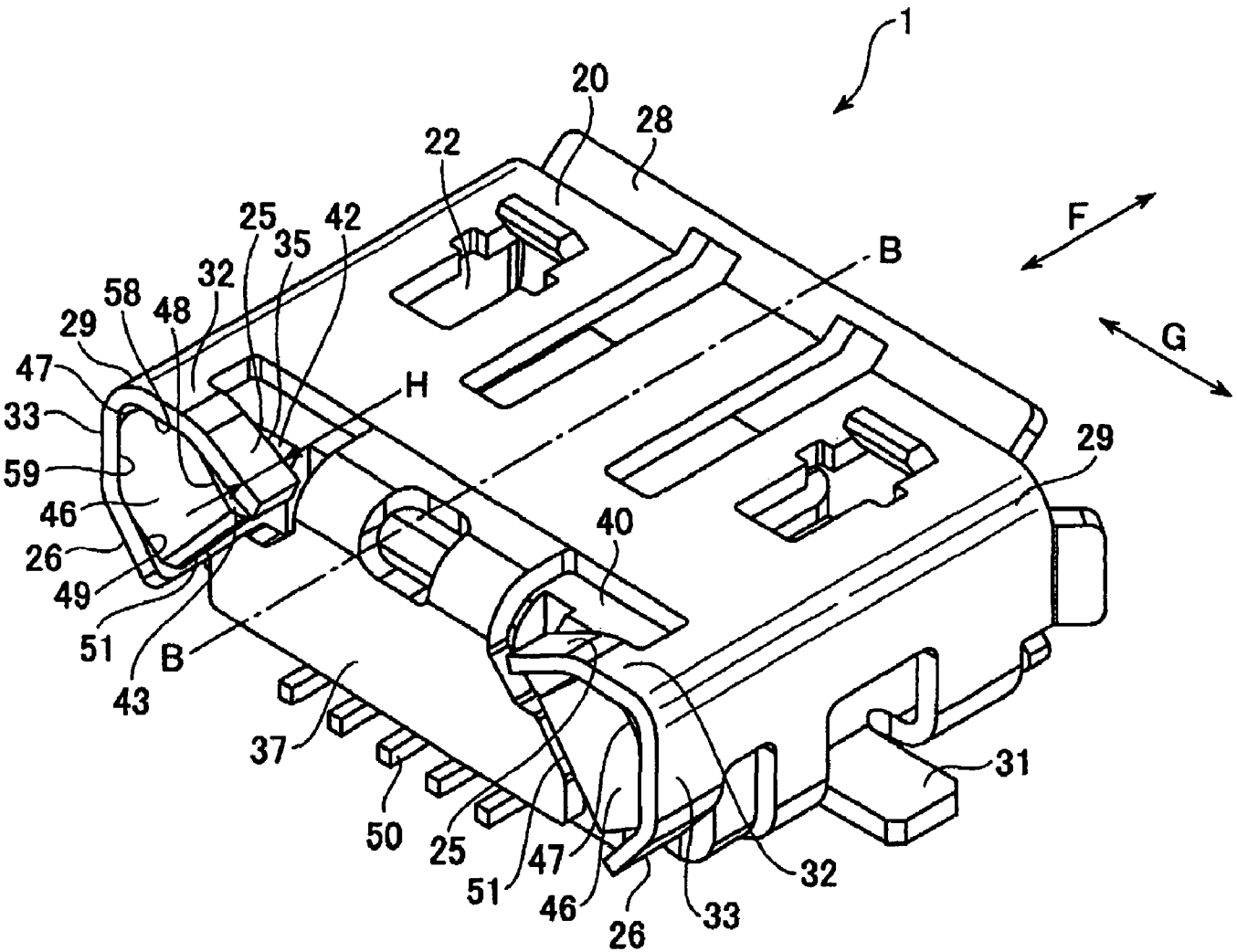
FIG. 1 is a rear perspective view of an electrical connector according to an embodiment of the invention.

Embodiments of the invention will now be described below with reference to the accompanying drawings.

In FIGS. 1-6, the plug connector 1 includes a housing 40 made of a resin, a metal cover or shell 20 to cover the housing 40, and terminals 50 arranged in the housing 40 with a narrow pitch. The plug connector 1 is symmetrical about the central line B-B extending along the plugging direction F. The housing 40 has a protruded portion 46 extending rearward from the rear end of a housing body. The protruded portion 46 does not project in the height direction. It is provided on each of opposite sides and has a substantially pentagonal cross-section and its bottom face 51 is inclined about the center line B-B. A tapered portion 42 is provided on the housing body so that the flat face 43, which includes a lower side 48, is connected to the housing body continuously.

Figure 4:
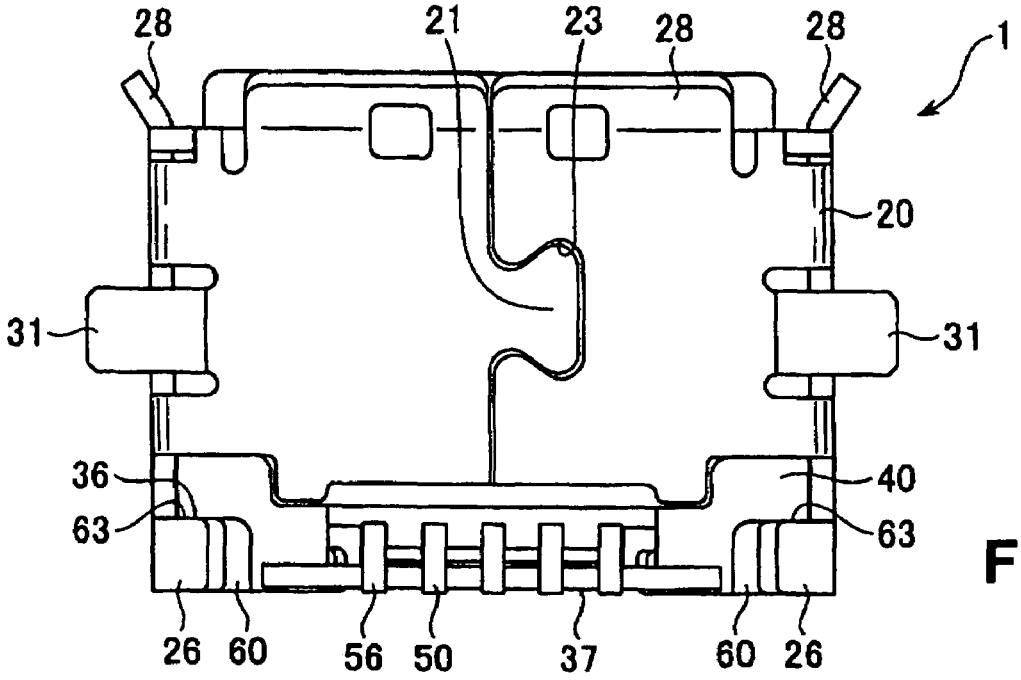
FIG. 4 is a bottom view thereof.

The shell 20 is made by stamping and bending a metal sheet. More specifically, a projection 21 and a recess 23 are provided on ends of a metal strip so that they are meshed with each other on the bottom of the shell 20 (FIG. 4). The housing 40 is inserted into the cylindrical shell 20 from the rear opening. Then, the rear wall 37 of the shell 20 is bent to fix the shell 20 to the housing 40. A solder tab 31 is provided on each side of the shell 20 for attachment to the board 70 in FIG. 6.

Figure 2:
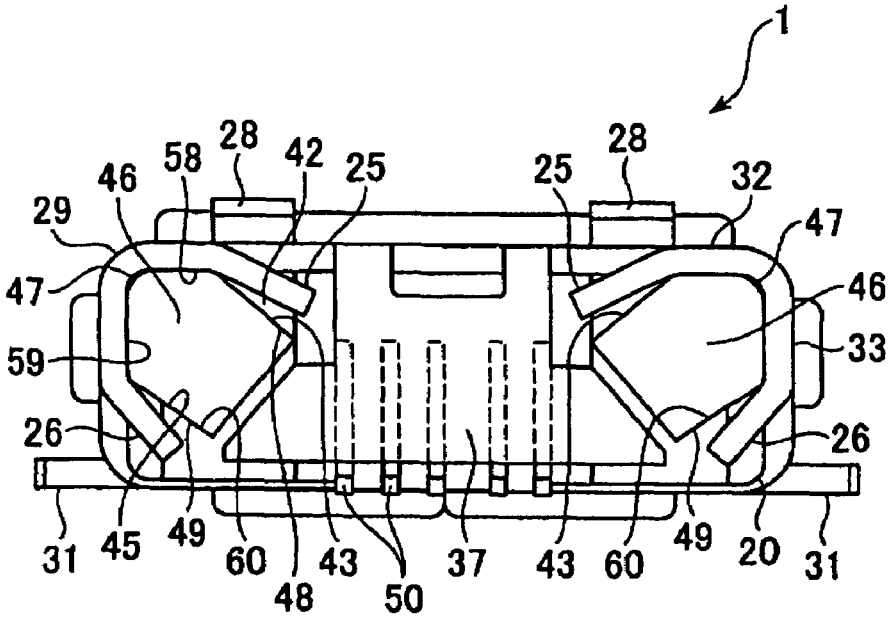
FIG. 2 is a rear view thereof.
Figure 3:
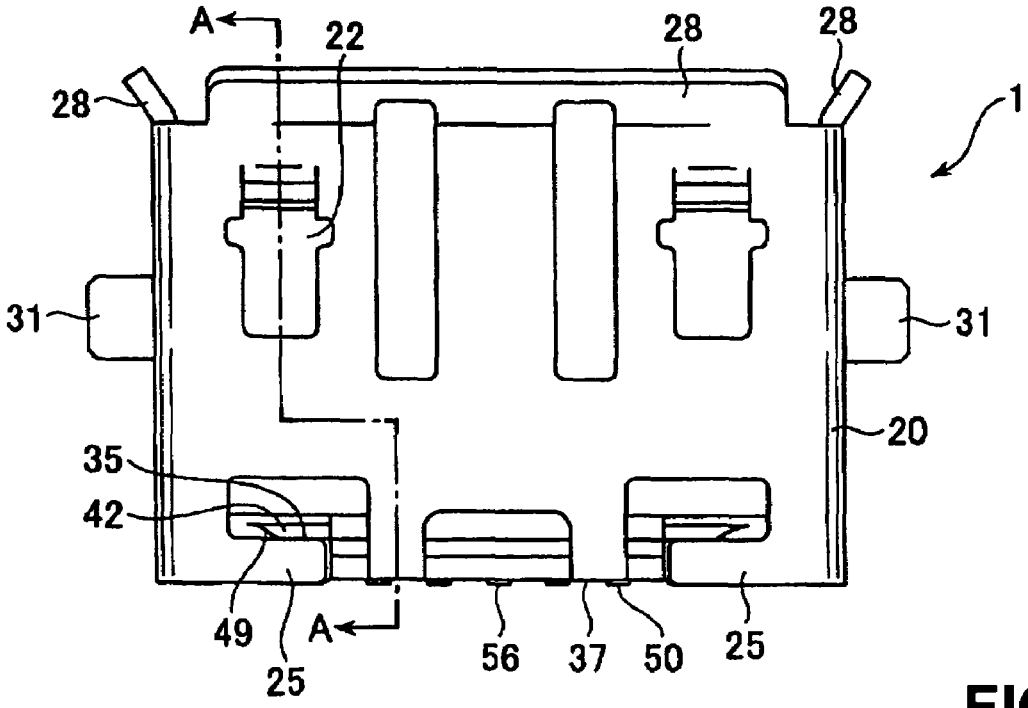
FIG. 3 is a top view thereof.

Tongue portions 25 and 26 of the shell 20 are deformed around the protruded portion 46 of the housing 40 to secure the shell 20 to the housing 40. The tongue portions 25 and 26 cover the flat face 43 that extends forward from the lower side 48 and the flat face 45 that extends forward from the lower side 49 (FIG. 2). Consequently, the base portions 32 and 33 are brought into close contact with the flat faces of the protruded portion 46 that extend forward from the upper sides 58 and 59. As a result, the shell 20 is secured to the housing 40 with larger force than before.

The tongue portions 25 and 26 are deformed on the protruded portion 46 such that the part of the housing 40 is dented or cut by the side edges 35 (FIGS. 1 and 3) and 36 (FIG. 4). Consequently, part of the tongue portions 25 and 26 is embedded in the housing 40 so that the shell 20 is secured to the housing 40 better than before. Especially, the tapered portion 42 makes it possible to embed the tongue portion 25 into the housing deeply. The area that is indented by the edge 36 of the tongue portion 26 near a boundary 63 between the connector body and the flat face 60 extending from the lower side 49 may be tapered as the tongue portion 25.

When the mating connector 80 is plugged in or unplugged from the electrical connector 1, the tongue portions 25 and 26 receive a large force in the plugging direction so that it is necessary for them to be sufficiently strong to endure this force. In this respect, the tongue portions 25 and 26 receive the force in the widthwise or H direction in FIG. 1 so that they are sufficiently strong against it. Consequently, the solder crack between the soldering tab 31 and the board is prevented.

Figure 5:
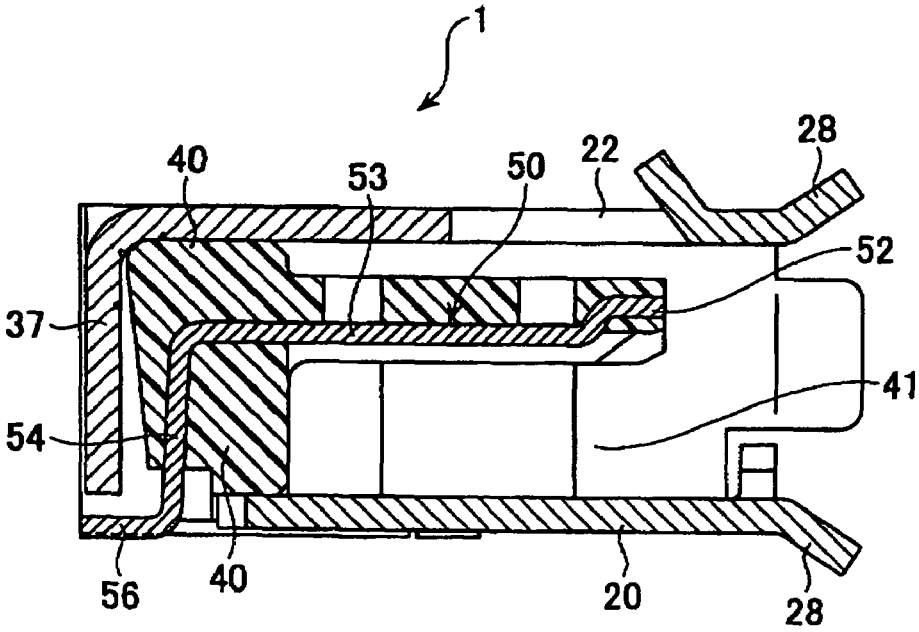
FIG. 5 is a sectional view taken along line A-A of FIG. 3.
Figure 6:
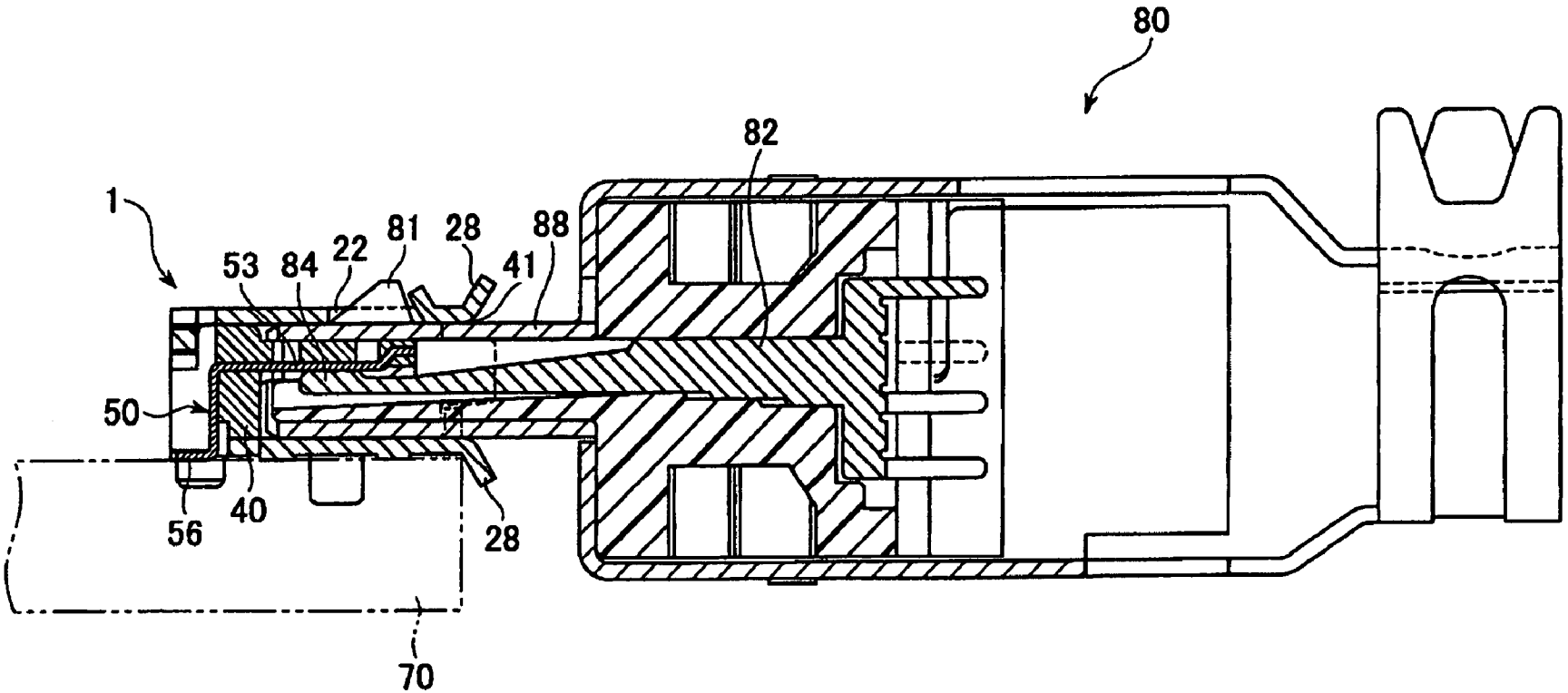
FIG. 6 is a sectional view taken along the center line of the electrical connector in which a mating connector is plugged.

In FIGS. 5 and 6, a terminal 50 is fixed to the housing 40 by integral molding such that the front and rear fixing portions 52 and 54 are fixed to the housing 40 while the intermediate contact portion 53 is exposed in a cavity 41 into which the mating connector is inserted. The rear soldering portion 56 is used for connection and fixation to the board 70.

As best shown in FIG. 6, when the plug connector 80 is plugged in the receptacle connector 1, the terminal support 88 of the mating connector 80 is inserted in the cavity 41. The terminal support 88 is guided by the guiding portion 28 of the electrical connector 1 into the cavity 41. Upon plugging, the contact portion 82 of a plug terminal 82 is brought into contact with the contact portion 53 of the electrical connector 1 while the lock portion 81 of the plug connector 80 is fitted in the engaging hole 22 of the electrical connector 1 so that the plug connector 80 is locked to the receptacle connector 1. The lock position is so close to the point where the shell 20 is attached to the housing 40 that the withstanding force upon the plugging in or out operation is enhanced.

Figure 7:
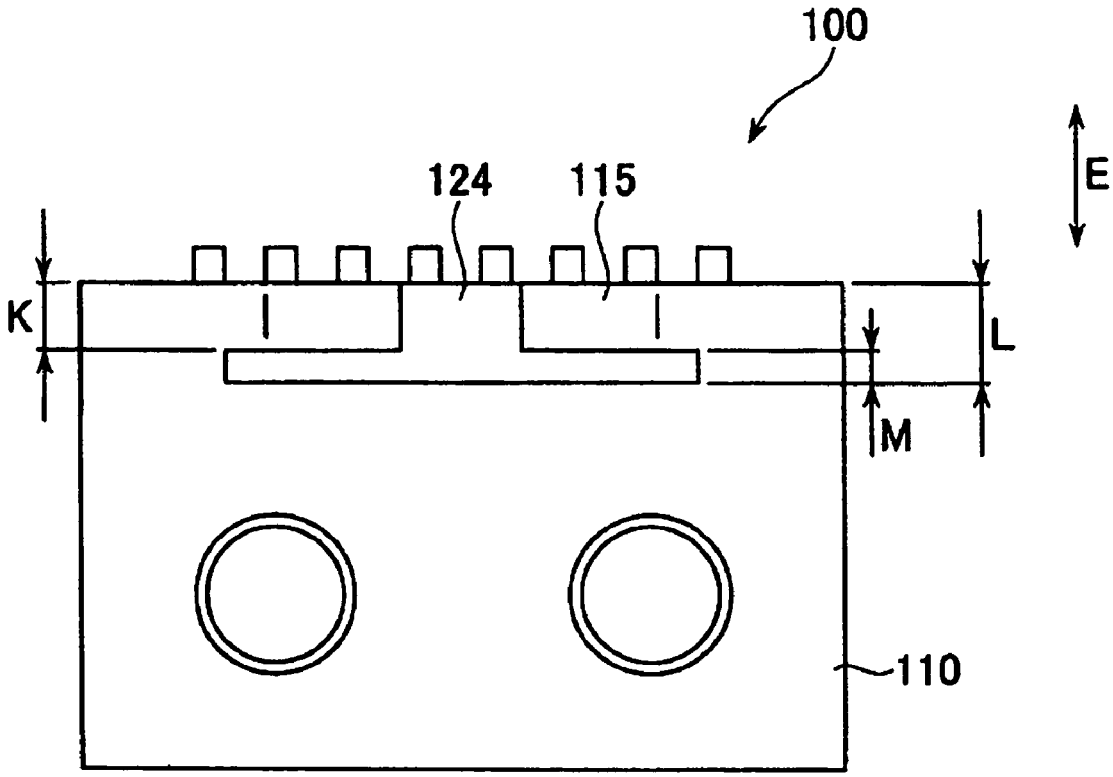
FIG. 7 PRIOR ART
FIG. 7 is a top view of a conventional connector.
Figure 8:
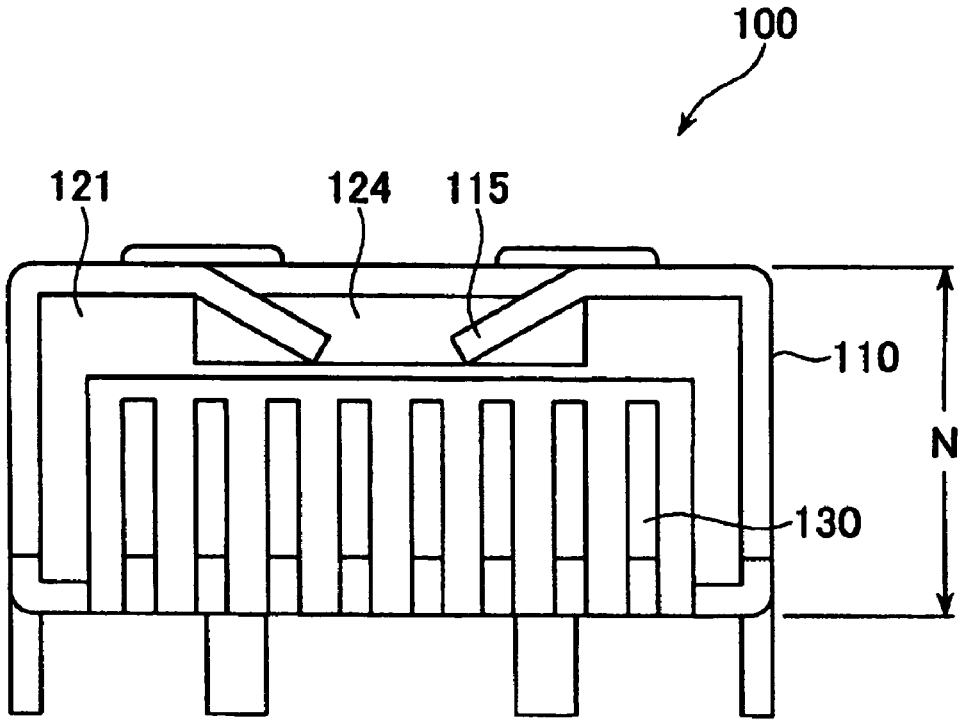
FIG. 8 PRIOR ART
FIG. 8 is a rear view of the conventional connector.

It is appreciated that the invention is applicable to other connectors than the electrical connector. In the above embodiment, the position where the housing cover is attached to the housing is located at the rear end of the housing but, as shown in FIGS. 7 and 8, it may be at a midway of the housing in the plugging direction. In this case, the tongue portion is provided at a midway of the housing cover while the housing is provided with an indentation as shown in FIG. 8.

The invention is useful for a connector with a housing to which a shell is attached.

The invention claimed is:

1. A connector comprising:

a housing;

a housing cover for covering at least part of said housing;

a plurality of terminals arranged in said housing;

a tongue portion extending from said housing cover in a direction perpendicular to a plugging direction such that a side of said tongue portion is brought into close contact with said housing, said tongue portion being provided with a side edge that cuts part of said housing.

2. The connector according to claim 1, wherein said housing has a dent made by said tongue portion.

3. The connector according to claim 1, wherein said tongue portion is provided at a rear end of said housing cover in said plugging direction.

4. The connector according to claim 1, wherein said housing is provided with a protruded portion extending rearward, around which said tongue portion is folded.

5. The connector according to claim 4, wherein said protruded portion is provided on each of opposite sides of said housing and said tongue portion is provided on each of opposite sides of said housing cover.

6. The connector according to claim 1, wherein said tongue portion is folded to said housing near a position where a mating connector is locked to said connector.

7. The connector according to claim 2, wherein said tongue portion is made of metal such that it has a width in said plugging direction.

8. The connector according to claim 2, wherein said tongue portion is provided at a rear end of said housing cover in said plugging direction.

9. The connector according to claim 2, which further comprises a protruded portion extending rearward from said housing, around which said tongue portion is folded.

10. The connector according to claim 3, which further comprises a protruded portion extending rearward from said housing, around which said tongue portion is folded.

11. The connector according to claim 2, wherein said housing is provided with a tapered portion in which said tongue portion is embedded.

12. The connector according to claim 3, wherein said housing is provided with a tapered portion in which said tongue portion is embedded.

13. The connector according to claim 4, wherein said housing is provided with a tapered portion in which said tongue portion is embedded.

14. The connector according to claim 5, wherein said housing is provided with a tapered portion in which said tongue portion is embedded.

15. A connector, comprising:

a housing;

a housing cover for covering at least part of said housing;

a plurality of terminals arranged in said housing;

a tongue portion extending from said housing cover in a direction perpendicular to a plugging direction such that a side of said tongue portion is brought into close contact with said housing, wherein said housing is provided with a tapered portion in which said tongue portion is embedded.

* * * * *